United States Patent [19]

Okada et al.

[11] Patent Number: 4,676,088

[45] Date of Patent: Jun. 30, 1987

[54] T-JOINT MANUFACTURING APPARATUS

[75] Inventors: Kenichi Okada; Hiroshi Asao, both of Yokohama; Hideo Yonemura, Katsuta, all of Japan

[73] Assignee: Hitachi, Ltd., Tokyo, Japan

[21] Appl. No.: 742,794

[22] Filed: Jun. 10, 1985

[51] Int. Cl.[4] ..... B21D 37/16

[52] U.S. Cl. ..... 72/342; 29/157 T

[58] Field of Search ..... 29/157 T; 72/69, 71, 72/296, 297, 305, 342, 352, 13, 128, 347, 370

[56] References Cited

U.S. PATENT DOCUMENTS

| | | | |
|---|---|---|---|
| 354,879 | 12/1886 | Youngs | 72/342 |
| 1,891,338 | 12/1932 | Snell | 72/342 |
| 2,227,476 | 1/1941 | Williams et al. | 72/342 |
| 3,368,377 | 2/1968 | Hirayama et al. | 72/128 |
| 3,815,395 | 6/1974 | Sass | 72/342 |
| 3,910,094 | 10/1975 | Luttgert et al. | 72/342 |
| 4,254,649 | 3/1981 | Cervenka et al. | 72/128 |
| 4,414,833 | 11/1983 | Nicolas et al. | 72/13 |

FOREIGN PATENT DOCUMENTS

| | | | |
|---|---|---|---|
| 81700 | 6/1983 | European Pat. Off. | 72/342 |
| 2753339 | 5/1979 | Fed. Rep. of Germany | 72/342 |
| 137030 | 8/1982 | Japan | 72/342 |
| 225813 | 12/1984 | Japan | 72/342 |
| 121018 | 6/1985 | Japan | 72/342 |
| 177914 | 9/1985 | Japan | 72/342 |

*Primary Examiner*—Lowell A. Larson

*Attorney, Agent, or Firm*—Antonelli, Terry & Wands

[57] ABSTRACT

This invention relates to an apparatus for manufacturing a T-joint, which consists of a tube portion and a collar portion, by using burring techniques. The apparatus is provided with a high-frequency induction heating unit for heating the circumferential portion of a pilot hole made in a tube, a cooling ring for ejecting a coolant to the circumferential portion of the pilot hole, and a temperature distribution control for controlling the heating rate of the heating unit and the coolant ejection rate of the cooling ring. The apparatus thus constructed enables the working temperature of the parts of the circumferential portion of the pilot hole in the plane of which includes the axes of the tube and the collar to be lower than that of the parts of the circumferential portion in the plane extending at right angle to the above-mentioned plane. Therefore, this apparatus can be used effectively to manufacture a T-joint of which the thicknes of the collar portion is substantially uniform in the circumferential direction of the circumferential portion of the pilot hole.

4 Claims, 6 Drawing Figures

T-JOINT MANUFACTURING APPARATUS

BACKGROUND OF THE INVENTION

This invention relates to a T-joint manufacturing apparatus, and more particularly to an apparatus for manufacturing a T-joint consisting of a tube portion, and a collar portion of which the thickness of a circumferential wall is substantially constant in its circumferential direction.

Known methods of and apparatuses for forming such a collar portion include, for example, the method and apparatus disclosed in Japanese Patent Lâid-Open No. 55171/1973.

As shown in FIG. 1, conventional T-joint manufacturing apparatus includes a tube, provided with a pilot hole, clamps 3 for fixing both end portions of the tube 1, a frusto-conical burring punch 4, and an annular heating coil 5 for use in subjecting a circumferential portion, i.e. a portion to be burred of the pilot hole in the tube 1 to high-frequency induction heating by applying thereto a high-frequency current generated by a high-frequency power source (not shown).

In operation, the tube 1 provided with a pilot hole is fixed at its both end portions by using fixing clamps 3, and the burring punch 4 is inserted into the tube 1 and fixed to a rod 6. A high-frequency current is applied to the annular heating coil 5 to subject the portion of the tube 1 to be burred to high-frequency induction heating at a predetermined temperature. The working force 7 is applied to the rod 6 with this working temperature retained, to carry out burring. Consequently, the collar portion 2 is formed to obtain a T-joint. However, such a T-joint manufacturing apparatus has a number of disadvantages. More particularly, as the burring operation progresses, the distance between the portion of the tube 1 being burred and the heating coil 5 varies, so that the working temperature varies causing the working force 7 to fluctuate, and even a slight error in the relationship between the shape of the tube and the shape and position of the collar formed at a portion of the tube 1 causes circumferentially unequal strain to occur in the collar portion 2 during the manufacture of the T-joint.

By virture of the above noted disadvantages, the T-joint manufacturing operation becomes unstable, and the thickness of the wall of the collar portion 2 of the resultant product differs greatly in the circumferential direction thereof. Especially, the thickness of the portions of the T-joint which are in the vicinity of points *2a, 2c* in the plane which includes the axes of the tube 1 and collar portion 2, is small, and, conversely, the thickness of the portions of the T-joint which are in the vicinity of the points *2b, 2d* in the plane extending at right angles to the above-mentioned plane is large. Accordingly, the strength of the portions of the T-joint which are in the vicinity of the points *2a, 2c* is small, and the reliability of the T-joint with respect to its strength is low. Also, cracking *2e* occurs in some cases in the vicinity of the points *2a, 2c* thereby weakening the T-joint.

SUMMARY OF THE INVENTION

An object of the present invention is to provide a T-joint manufacturing apparatus which is capable of setting the working temperature at the portions of a workpiece the thickness of which tends to decrease greatly, in a lower level than that at the portions of the workpiece the thickness of which decreases slightly so as to prevent the fluctuation of the working force, whereby a T-joint, of which the thickness of the collar portion is constant in the circumferential direction thereof, can be obtained.

DETAILED DESCRIPTION

Figure 2:
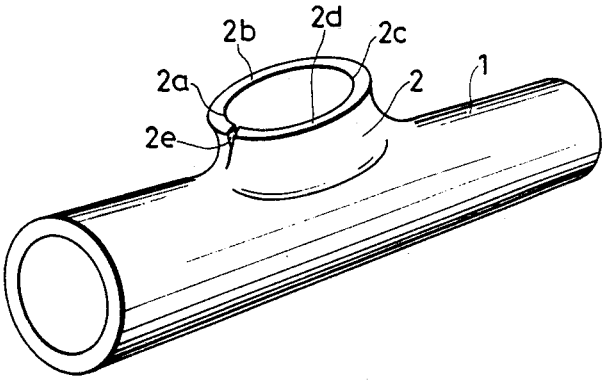
FIG. 2 PRIOR ART
FIG. 2 is a perspective view of a T-joint obtained by using the T-joint manufacturing apparatus of FIG. 1.

The basic points of the present invention will now be described with reference to FIGS. 2 and 3.

In a T-joint produced by a conventional T-joint manufacturing apparatus, strain tends to occur in a concentrated manner in the vicinity of the points *2a, 2c* in the collar portion 2 as stated before (refer to FIG. 2), and the wall thickness at these points *2a, 2c* becomes very small. Therefore, this T-joint does not have a satisfactorily high strength. According to the present invention, the collar portion 2 is formed so that the thickness of the wall thereof becomes substantially uniform in the circumferential direction thereof, by controlling the deformation at the points *2a, 2c* at which the collar portion 2 is plastically deformed considerably, and increasing the degree of plastic deformation at the points *2b, 2d* at which the collar portion 2 is plastically deformed only slightly.

Figure 3:
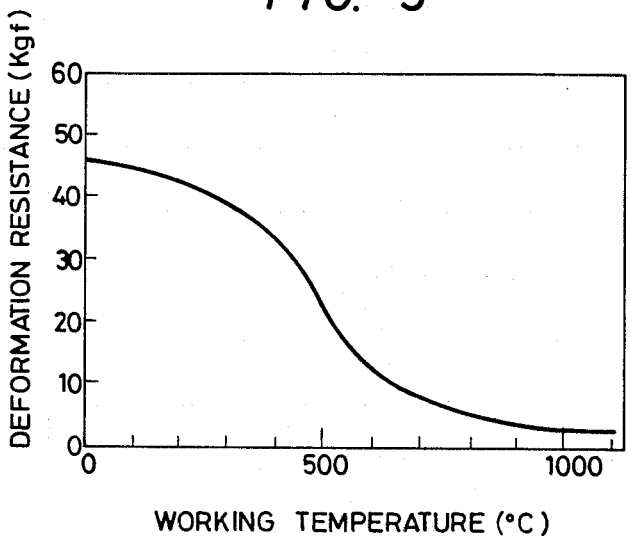
FIG. 3 is a curve showing the relation between the working temperature for a carbon steel pipe and the deformation resistance thereof.

As shown in FIG. 3, the deformation resistance of, for example, a carbon steel pipe, depends on the working temperature. Namely, when the working temperature is low, the deformation resistance of the tube 1 is high, and, when the working temperature increases to a high level, the deformation resistance of the tube 1 is low with the plastic deformation rate thereof increasing. Hence, if the working temperature in the vicinity of the points *2a, 2c,* at which deformation is concentrated, is set lower than that in the vicinity of the points *2b, 2d* when a T-joint is formed, the plastic deformation rate at the points *2a, 2c* can be minimized, and that at the points *2b, 2d* can be increased. This enables the wall thickness of the collar portion to become substantially uniform in the circumferential direction thereof.

Figure 1:
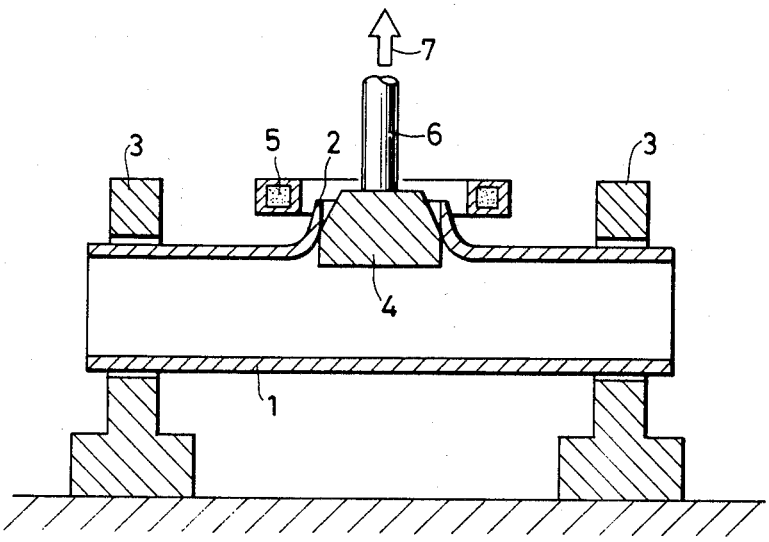
FIG. 1 PRIOR ART
FIG. 1 is a schematic section of a conventional T-joint manufacturing apparatus, and a tube formed thereby.
Figure 4:
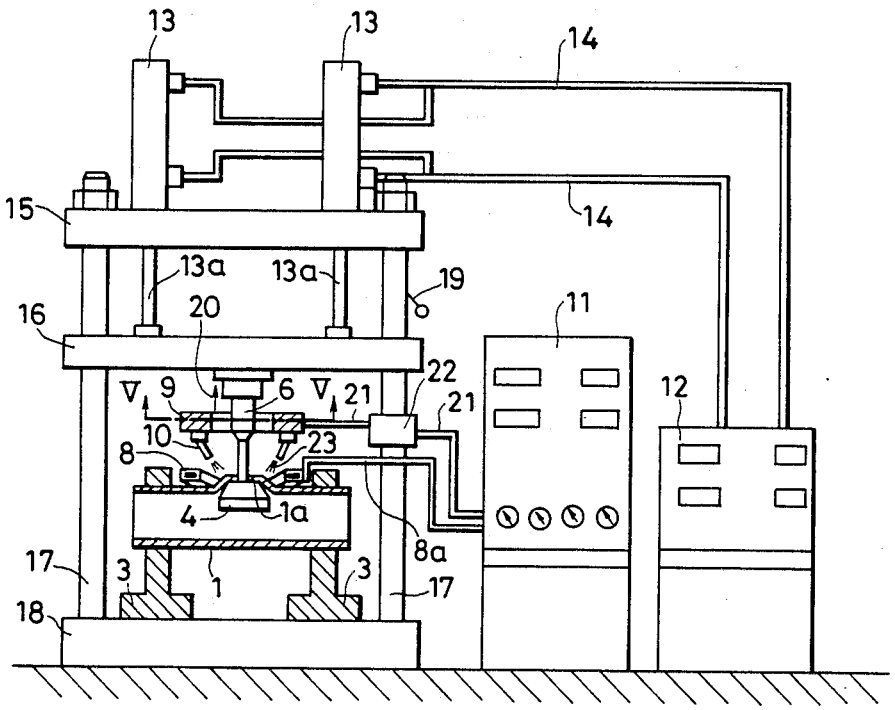
FIG. 4 is a front elevation of an embodiment of the T-joint manufacturing apparatus according to the present invention.

Referring now to FIG. 4 wherein like reference numerals are used to the same parts as in FIG. 1 is a tube 1 provided with a pilot hole *1a,* with the tube-fixing clamps 3 being firmly set by support posts 17 provided on a lower bed 18. A cross head 16 has a rod 6 fixed to a lower surface thereof and used to withdraw a burring punch 4 from the interior of the tube 1 via the pilot hole *1a,* and which can be moved up and down along the support posts 17. An upper bed is fixed to upper end portions of the support posts 17, and hydraulic cylinders 13 are fixed to the upper bed 15 and are capable of applying the working force 20 to the rod 6 via the cross head 16 which is fixed to the lower ends of spindles 13*a* fitted therein. The hydraulic cylinders 13 are adapted to be driven upward by the hydraulic pressure, which is generated in a press operating unit 12 and introduced thereinto through pipes 14, and stop moving up when the cross head 16 engages with a limit switch 19. A saddle-type heating coil 8 is disposed in the vicinity of the pilot hole 1*a* of the tube 1 and is formed so that a distance between the heating coil and tube 1 is substantially equal over the whole circumference of the heating coil 8. When a high-frequency current generated in a temperature distribution control system 11, to be described more fully hereinbelow, is introduced into this heating coil 8 through a wire 8*a*, a circumferential portion of the pilot hole 1*a* can be subjected to high-frequency induction heating.

Figure 5:
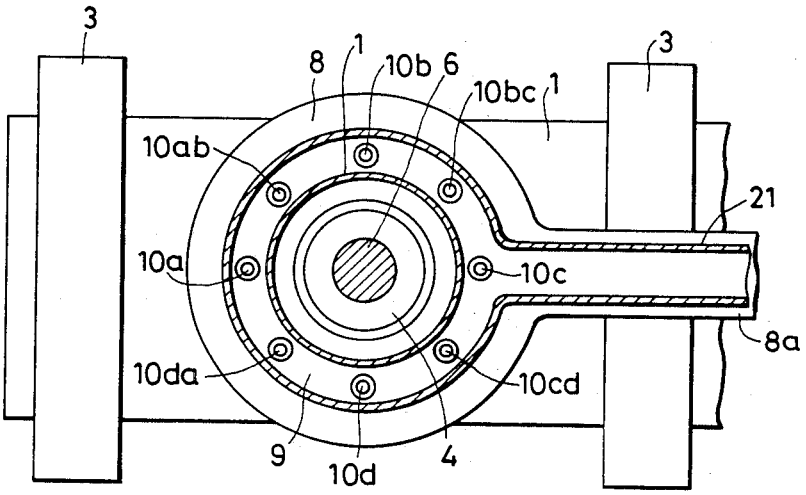
FIG. 5 is an enlarged section taken along the line V—V in FIG. 4.

A cooling ring 9 is provided with eight nozzles 10 which are capable of ejecting toward the circumferential portion of the pilot hole 1*a* a coolant consisting of, for example, a mixed fluid 23 of water and air. These eight nozzles 10 are disposed at 45° intervals in positions 10*a*, 10*ab*, 10*b*, 10*bc*, 10*c*, 10*cd*, 10*d*, 10*da* as shown in FIG. 5. Out of these positions, the positions 10*a*, 10*b*, 10*c*, 10*d* correspond to the points 2*a*, 2*b*, 2*c*, 2*d*, respectively, on the previously mentioned collar portion 2 (refer to FIG. 2). These eight nozzles are connected separately to the temperature distribution control system 11. The cooling ring 9 is fixed to the support post 17 by a metal fastener 22 secured to a pipe 21 connected to the cooling ring 9.

The temperature distribution control system 11 is constructed so that it can generate a high-frequency current to be applied to the saddle-shaped heating coil 8 and control this output. It is also adapted to receive signals from a plurality of two-color ratio pyrometers for working temperature detectors, which are provided at the free ends of the nozzles 10, and control the flow rates of the water and air ejected from the respective nozzles 10, whereby the working temperatures at the points 2*a*, 2*b*, 2*c*, 2*d* on the circumferential portion of the pilot hole 1*a* can be regulated automatically to a predetermined level.

The procedure for manufacturing a T-joint from a tube by using the T-joint manufacturing apparatus of the above-mentioned construction will now be described.

First, a tube 1 provided with a pilot hole 1*a* at a predetermined portion thereof is set firmly at both end portions thereof by fixing clamps 3. A saddle shaped heating coil 8 is set above and near the circumferential portion of the pilot hole 1*a*. A burring punch 4 is inserted into the interior of the tube 1 and engaged firmly with a threaded portion (not shown) provided at a free end of a rod 6.

A predetermined working temperature distribution is set by a temperature distribution control system 11 so that the working temperature of for example, 700° C., in the vicinity of points 2*a*, 2*c* at which strain is concentrated is lower than that of, for example, 900° C., in the vicinity of points 2*b*, 2*d* which are 90° from the points 2*a*, 2*c*, respectively.

When the T-joint manufacturing apparatus is then turned on, the circumferential portion as a whole of the pilot hole 1*a* is heated by the heating coil 8 to a temperature higher than the working temperature. A mixed fluid 23 of water and air is then ejected from nozzles 10. The flow rate of the fluid 23 from the respective nozzles 10 is controlled on the basis of signals from the two-color ratio pyrometer secured thereto. Thus, the circumferential portion of the pilot hole 1*a* is forcibly cooled so that this portion of the hole 1*a* has a predetermined temperature distribution. When the temperature distribution has become substantially stable in the mentioned predetermined level, the hydraulic cylinders 13 are actuated by a press operating unit 12 to cause the cross head 16 to move up. Consequently, the working force 20 is applied to the rod 6, and a burring operation is carried out by the burring punch 4 to form a collar portion 2A. Since the working temperature at the points 2*a*, 2*c*, at which strain occurs in a concentrated manner, is controlled to be low, the deformation resistance in the vicinity of these points becomes high, so that the plastic deformation of the collar portion 2A in the area of these points can be minimized.

When the burring punch 4 has been withdrawn completely from the pilot hole 1*a* with the cross head 16 engaging with a limit switch 19, the cross head 16 stops moving up, so that the temperature distribution control system 11 is turned off. When the product is taken out after it has been cooled, a T-joint without cracks, having a substantially uniform wall thickness in the circumferential direction of the collar portion 2A is obtained.

An example of the present invention will now be described.

Forming a collar portion 2A of 195.7 mm in inner diameter on a carbon steel pipe of 318.5 mm in outer diameter, 10.3 mm in wall thickness and 2 m in length which constitutes a tube 1 will be described.

A curve representing the relationship between the working temperature for the carbon steel pipe and the deformation resistance thereof is as shown in FIG. 3.

The conditions for a high-frequency induction heating operation using a saddle-type heating coil 8 (of about 260 mm in inner diameter) include a constant frequency of 2.5 kHz, a working temperature of about 900° C. in the vicinity of the points 2*b*, 2*d*, and a working temperature of 700° C. in the vicinity of the points 2*a*, 2*c* which are spaced at 90° from the points 2*b*, 2*d*, respectively. If there is a difference of 200° C. between such two working temperatures in the temperature zone including the same, the ratio of the deformation resistance at one of these four points to that at another which is 90° spaced therefrom is about 1:2 as clearly understood from FIG. 3. The burring punch 4 has a frusto-conical shape, and has an outer diameter of 195.7 mm and a half vertical angle of 30°, and the working force 20 is set to 14tf.

The above carbon steel pipe is burred under these conditions by the same T-joint manufacturing apparatus as shown in FIG. 4. As a result, a T-joint of which the collar portion 2A has a substantially constant wall thickness in the circumferential direction thereof can be formed without any fluctuations of the working force 20.

The construction, which constitutes the gist of the present invention, of the means for setting the working temperature at the portion of the circumferential section of the pilot hole in which the wall thickness tends to decrease greatly, to a lower level than that at the portion thereof in which the wall thickness decreases slightly is not limited to that employed in the embodiment described in detail above. Even if the above-described heating coil is modified to the shape of an ellipse and set so that the longer axis thereof extends in the axial direction of the tube, an excellent effect can also be obtained.

Figure 6:
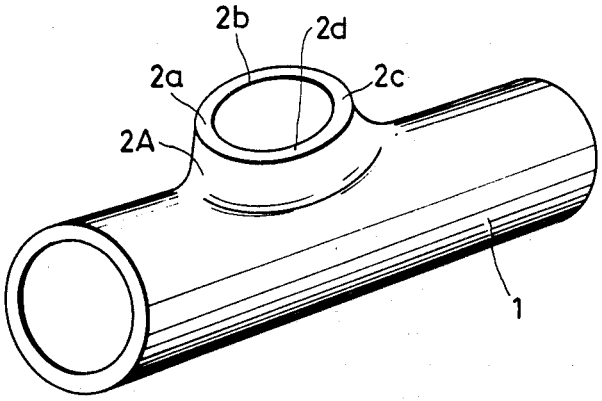
FIG. 6 is a perspective view of a T-joint obtained by using the T-joint manufacturing apparatus of FIG. 4.

Namely, when an elliptic ring type coil (not shown) is used instead of the heating coil 8 (annular coil) shown in FIG. 5, the distance between the points on the inner circumferential surface of the elliptic coil which are in the plane including the longer axis thereof and the points *2a, 2c* (shown in, for example FIG. 6) on the circumferential portion of the lower bore becomes longer than that between the points on the inner circumferential surface of the elliptic coil which are in the plane including the shorter axis thereof and the points *2b, 2d* (shown in, for example, FIG. 6) on the circumferential portion of the pilot hole. Accordingly, the parts, which are around the points *2a, 2c,* of the circumferential portion of the lower bore are more difficult to heat than the parts thereof which are around the points *2b, 2d;* and the working temperature in the vicinity of the former points is lower than that in the vicinity of the latter points. Therefore, as may be understood from the graphical relationship in FIG. 3, the deformation resistance of the parts around the points *2a, 2c* is high, so that the rate of plastic deformation thereof is minimal. This enables the wall thickness of the collar portion to be made substantially uniform in the circumferential direction thereof without using any special cooling means.

Obviously, even if the above-described cooling means is used with a heating means consisting of an elliptic ring type heating coil, excellent results can also be obtained.

Since the collar has a substantially uniform wall thickness, the reliability of the T-joint with respect to its strength can be improved.

Moreover, cracking *2e* which often occurs at the free end of the collar portion 2 of a conventional T-joint, can be prevented. This can be very effective in preventing the appearance of the T-joint from being spoiled.

The embodiment was described with reference to a carbon steel pipe is used as the material for a tube 1. The present invention is not limited to the use of a carbon steel pipe; it can be applied to the case where a T-joint is manufactured by using any metal pipe or alloy pipe, for example, a stainless steel pipe and a steel alloy pipe.

In the above-described embodiment of the present invention, a burring operation is carried out by a heating means disposed in the vicinity of the circumferential portion of the pilot holes in a tube. The steps of heating the region of a tube which is a slight distance from the circumferential portion of the pilot hole to a predetermined working temperature before subjecting this circumferential portion to a burring operation, so as to hot-bulge this region with a burring punch, and thereafter subjecting the circumferential portion to a burring operation can also be used effectively.

What is claimed is:

1. A T-joint manufacturing apparatus having a temperature distribution control means for heating the circumferential portion of a pilot hole provided in a tube, a burring punch inserted in the interior of said tube, and a burring means for drawing a wall portion of said pilot hole in a heated and cooled state via said burring punch, wherein said temperature distribution control means comprises a high frequency induction heating means and a cooling means comprising a plurality of nozzle means for respectively ejecting a coolant toward a selected part of the circumferential portion of said pilot hole, said temperature distribution control means separately controlling the coolant ejection rate through each nozzle so as to enable the working temperature of the parts of the circumferential portion of the pilot hole in the plane which includes the longitudinal axis of said tube and a collar of the pilot hole to be lower than that of the parts of said circumferential portion in the plane extending at a right angle to said plane.

2. A T-joint manufacturing apparatus according to claim 1, wherein said high frequency induction heating means comprises a saddle type heating coil.

3. A T-joint manufacturing apparatus according to claim 1, wherein said high-frequency induction heating means comprises a saddle type high-frequency induction heating coil, and said cooling means comprises a cooling ring including the plurality of nozzle means which are separately capable of ejecting a coolant toward the selected part of the circumferential portion of said pilot hole.

4. A T-joint manufacturing apparatus according to claim 1, wherein said cooling means comprises a cooling ring including the plurality of nozzle means which are separately capable of ejecting a coolant toward the selected part of the circumferential portion of said pilot hole.

* * * * *